US006685130B2

(12) United States Patent
Stauber et al.

(10) Patent No.: US 6,685,130 B2
(45) Date of Patent: Feb. 3, 2004

(54) METHOD AND INSTALLATION FOR EXCHANGING ROLL SUPPORTS ON WINDING STATIONS ARRANGED IN A ROW

(75) Inventors: Hans Ulrich Stauber, Grüt (CH); Erwin Müller, Dürnten (CH)

(73) Assignee: Ferag AG, Hinwil (CH)

( * ) Notice: Subject to any disclaimer, the term of this patent is extended or adjusted under 35 U.S.C. 154(b) by 60 days.

(21) Appl. No.: 10/001,443

(22) Filed: Nov. 21, 2001

(65) Prior Publication Data

US 2002/0070309 A1 Jun. 13, 2002

(30) Foreign Application Priority Data

Nov. 24, 2000 (CH) ..... 2290/00

(51) Int. Cl.[7] ..... B65H 19/30; B65G 65/00

(52) U.S. Cl. ..... 242/533.8; 242/528; 242/559.4; 414/277; 414/278; 414/286; 414/911

(58) Field of Search ..... 242/533.8, 528, 242/533, 539, 399.1, 401, 406, 559, 559.1, 559.2, 559.3, 559.4, 560; 414/277, 278, 279, 280, 282, 286, 911

(56) References Cited

U.S. PATENT DOCUMENTS

| | | | | |
|---|---|---|---|---|
| 3,695,539 | A | * | 10/1972 | Lindstaedt |
| 4,587,790 | A | | 5/1986 | Muller |
| 4,676,496 | A | | 6/1987 | Honegger |
| 4,703,901 | A | | 11/1987 | Stauber |
| 4,752,176 | A | * | 6/1988 | Linder |
| 4,863,335 | A | * | 9/1989 | Herigstad et al. |
| 5,007,522 | A | * | 4/1991 | Focke et al. |
| 5,022,807 | A | * | 6/1991 | Linder |
| 5,076,751 | A | * | 12/1991 | Kafka |
| 5,085,377 | A | * | 2/1992 | Rohrer et al. |
| 5,379,963 | A | | 1/1995 | Stauber |
| 5,388,955 | A | * | 2/1995 | Schroder |
| 5,398,883 | A | * | 3/1995 | Stauber |
| 5,673,869 | A | | 10/1997 | Honegger |
| 5,749,568 | A | | 5/1998 | Reist |
| 5,947,463 | A | * | 9/1999 | Honegger |
| 6,155,516 | A | * | 12/2000 | Lehrieder et al. |
| 6,264,133 | B1 | | 7/2001 | Herrmann |

FOREIGN PATENT DOCUMENTS

| | | |
|---|---|---|
| EP | 0 950 626 A1 | 10/1999 |
| GB | 2 170 793 A | 8/1986 |

* cited by examiner

*Primary Examiner*—William A. Rivera
(74) *Attorney, Agent, or Firm*—Rankin, Hill, Porter & Clark LLP

(57) ABSTRACT

To a row of winding stations (1), in which rolls (8) of flat, bendable objects (e.g., printed products) positioned on roll supports (3) are processed or in which such rolls are produced, roll supports (3) are coupled to the winding stations and, if required, are exchanged, the coupled roll supports forming a first row (A) of roll supports parallel to the row of winding stations (1). Roll supports (3) are positioned in readiness for the exchange in a second row (B) of roll supports, which second row (B) is distances from the first row (A) by a transport alley (10). Each roll support in the second row is aligned to the one winding station (1), to which it is to be coupled. For every exchange, the roll support (3) coupled to the winding station (1) is moved transverse to the first row (A) into the transport alley (10) and is transported along the transport alley to its end and there is positioned in a third row (C) of roll supports, which is aligned in the direction of the transport alley (10) and adjoins it.

17 Claims, 5 Drawing Sheets

METHOD AND INSTALLATION FOR EXCHANGING ROLL SUPPORTS ON WINDING STATIONS ARRANGED IN A ROW

BACKGROUND OF THE INVENTION

The invention is related to the field of materials handling technology and storage technology and concerns a method and an installation serving for exchanging roll supports in a plurality of winding stations arranged in a row and essentially parallel to one another. The roll supports each carry a roll core and a multitude of bendable, flat objects (e.g., printed products) that can be wound onto the core with the aid of a winding tape to form a roll. The winding stations unroll objects from rolls on roll supports or produce rolls by winding objects onto the roll core of roll supports.

For intermediate storage or transport, it is known in the printing industry to wind printed products or parts thereof in an imbricated formation onto a roll core with the help of a winding tape, to transport the rolls and/or to place them into intermediate storage and, when so required, to once again unwind the imbricated formation of printed products from the rolls. The rolls usually have a diameter of up to two meters and weigh up to a ton. The axial width of such rolls essentially corresponds to the width of the rolled products and amounts to, for example, 30 to 50 cm.

For exchanging rolls and roll cores on winding stations, either rolls and empty roll cores as such (without any further aids) are handled or else so-called roll supports carrying each a roll or an empty roll core are utilized. The roll supports are usually simple, mobile, if so required passively traveling devices, on which a roll core is arranged freely rotatable around a horizontal winding axis. Usually the roll supports also comprise devices for winding and unwinding the winding tape. On the roll core of an "empty roll support", no printed products are rolled, a "loaded roll support" carries a roll of printed products.

Examples of roll supports are described in the publications DE-3236866 (or U.S. Pat. No. 4,587,790). EP-0149058 (or U.S. Pat. No. 4,676,496). EP-0242607 (or U.S. Pat. No. 4,703,901) or EP-0719720 (U.S. Pat. No. 5,673,869).

Roll supports and winding stations are usually matched to one another such that the printed products are unrolled directly from a roll support coupled to the winding station or can be wound directly onto the roll core of the roll support. To do so, the roll support is positioned on the winding station side opposite to the side on which the imbricated formation is removed or supplied and, usually, the roll or roll core is aligned in the direction of the product removal or supply. For reasons of space, the roll or roll core may be positioned at a slight angle to the winding station.

Winding stations are, for example, arranged along processing routes (e.g., collecting drums, collating devices) and serve for supplying part products from rolls to the processing route. Along such a processing route, finished printed products are produced from a plurality of part products being supplied to the processing route. The supply direction for the part products is usually substantially perpendicular to the processing route and the winding stations are arranged on one side or on both sides of the processing route in one or in two rows, wherein the roll supports coupled to the winding stations form a row of roll supports running parallel to the row of winding stations.

For various reasons it is desirable that processing routes of this kind are as short as possible. For the winding stations this means that they should be as narrow as possible in the direction of the processing route, i.e., transverse to the supply direction. This also applies to the roll supports and it also means a restriction of the space available for exchanging the roll supports.

Roll supports according to prior art are, for example, manipulated and transported coupled to suitable vehicles or lifted by loading forks of corresponding vehicles. Such manipulation is only suitable for exchanging roll supports on winding stations if no high demands are made of the exchange speed and of the degree of automation, if storage locations for the roll supports are relatively far away from the winding stations and/or are frequently changing and if sufficient space is available for shunting in the area of the winding stations.

If storage space for roll supports is available in the closer proximity to the winding stations on a permanent basis, then it is advantageous to provide for manipulation of the roll supports specialized devices equipped for not only exchanging the roll supports but also for putting them into storage and for taking them out of storage, which devices are connected to permanent installations as described, for example in the publication EP0950626.

It is also known, for example, from the publication EP-0527702 (or U.S. Pat. No. 5,379,963), which describes the exchange of rolls (not roll supports) on winding stations, to carry out the actual roll exchange with fixed installations, to use freely travelling vehicles for transport and storage and to install correspondingly equipped transfer places between the two (advantageously as close as possible to the winding stations).

SUMMARY OF THE INVENTION

It is an object of the invention to create a method and an installation for exchanging roll supports on a plurality of winding stations arranged in a row, wherein roll supports positioned in readiness for the exchange in the area of the winding stations by other suitable means are supplied to the winding stations, and wherein roll supports are removed from the winding stations and are positioned in the area of the winding station to be transported away by other suitable means. The method and device in accordance with the invention to make it possible to carry out the roll support exchange very rapidly, such that only little buffering capacity is necessary for enabling continuous product supply to the winding process or continuous product removal from the unwinding process. Nonetheless, the method and device are simple and space-saving and are able to be integrated without problems into known transport and storage processes for roll supports.

In accordance with the invention, for exchanging roll supports being coupled to a row of winding stations (first row of roll supports), further roll supports are positioned in readiness in a second row of roll supports, the second row being substantially parallel to the first row of roll supports and distanced from it by a transport alley. Each roll support in readiness is aligned to the one winding station, to which it is to be coupled and the orientation of its roll or roll core suitable for the coupling. The winding axes of the positioned roll supports are parallel to the direction of the row of roll supports and aligned to one another, the roll cores in essence being arranged coaxially. The transport alley between the first and the second row of roll supports has a width that is greater than the dimension of the roll supports transverse to the winding axis.

For exchanging a roll support, the procedure in accordance with the invention is as follows:

The roll support coupled to the winding station is uncoupled from the winding station and is transported transverse to the first row of roll supports and away from it into the transport alley and thereupon along the transport alley up to its end, where it is positioned for being transported away into a third row of roll supports extending approximately in the same direction as the transport alley. While the removed roll support is transported away along the transport alley, the roll support positioned in the second row in readiness for the exchange at the corresponding winding station is moved transverse to its winding axis across the transport alley to the winding station (into the first row of roll supports) and is coupled to it.

It is obvious, that roll support exchanges on different winding stations of the row can be carried out simultaneously or overlapping each other temporally. For rapid exchanges, it has to be assured that transportation of removed roll supports along the transport alley does not interfere with transportation across the transport alley, which is to have priority. Depending on the length of the transport alley or on the number of the winding stations respectively and depending on the frequency of the roll support exchanges, it may be advantageous to carry out the transportation steps transverse to the transport alley and along the transport alley on different levels such that they are essentially independent of one another. It is equally conceivable to provide third roll support rows at both ends of the transport alley and to thus enable transportation along the transport alley in two directions.

The device according to the invention in essence comprises two means of transportation:

a transverse transport means for moving roll supports positioned in readiness in the second row across the transport alley to the predetermined winding station and for transporting roll supports to be removed from the winding station into the transport alley, and a longitudinal transport means for transporting roll supports to be removed along the transport alley to the third row of roll supports and for positioning them in this third row.

For positioning the roll supports to be coupled to the winding stations in readiness (second row), which positioning is not part of the invention, for example freely traveling fork lift trucks or other vehicles suitable for handling roll supports are employed. Preferably, the same vehicles are employed also for transporting away the roll supports positioned in the third row at the end of the transport alley, which transporting away is also not part of the invention.

The functional steps of transverse and longitudinal transport means for one roll support exchange include the following:

The transverse transport means takes hold of a roll support in the first row, the roll support having been uncoupled from the winding station, and moves it into the transport alley;

the roll support removed from the winding station is taken over by the longitudinal transport means and is transported away along the transport alley toward the third row of roll supports;

simultaneously, the transverse transport means takes hold of the corresponding roll support positioned in readiness in the second row of roll supports and transports it across the transport alley into the first row of roll supports.

The longitudinal transport means advantageously comprises a transportation organ extending over the whole length of the transport alley and the third row of roll supports adjoining it, for example, a conveyor belt or a roller conveyor such that roll supports from any winding station can be transferred to this transport means and transported by it simultaneously.

The transverse transport means advantageously is of a modular construction, wherein for every winding station or for a group of adjacent winding stations, an individually operating transverse conveying module is provided. The transverse conveying module, for example is designed as a roller track conveyor or as lifting equipment movable in two directions along a rail track.

In the area of the transport alley suitable means are to provided for making sure that transverse and longitudinal transport means do not interfere with one another. In this respect, roll supports moved by the transverse transport means toward the winding stations have to be able to cross the longitudinal transport means unhindered, if possible also when the longitudinal transport means is in operation. Furthermore, roll supports to be transported away have to be able to be transferred to the longitudinal transport means by the transverse transport means and roll supports moved along the transport alley by the longitudinal transport means have to be able to cross the transverse transport means in the area of other winding stations.

The above conditions are fulfilled in the most simple manner if one of the transverse and longitudinal transport means essentially acts from below (standing transport) and the other one essentially acts from above (hanging transport).

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
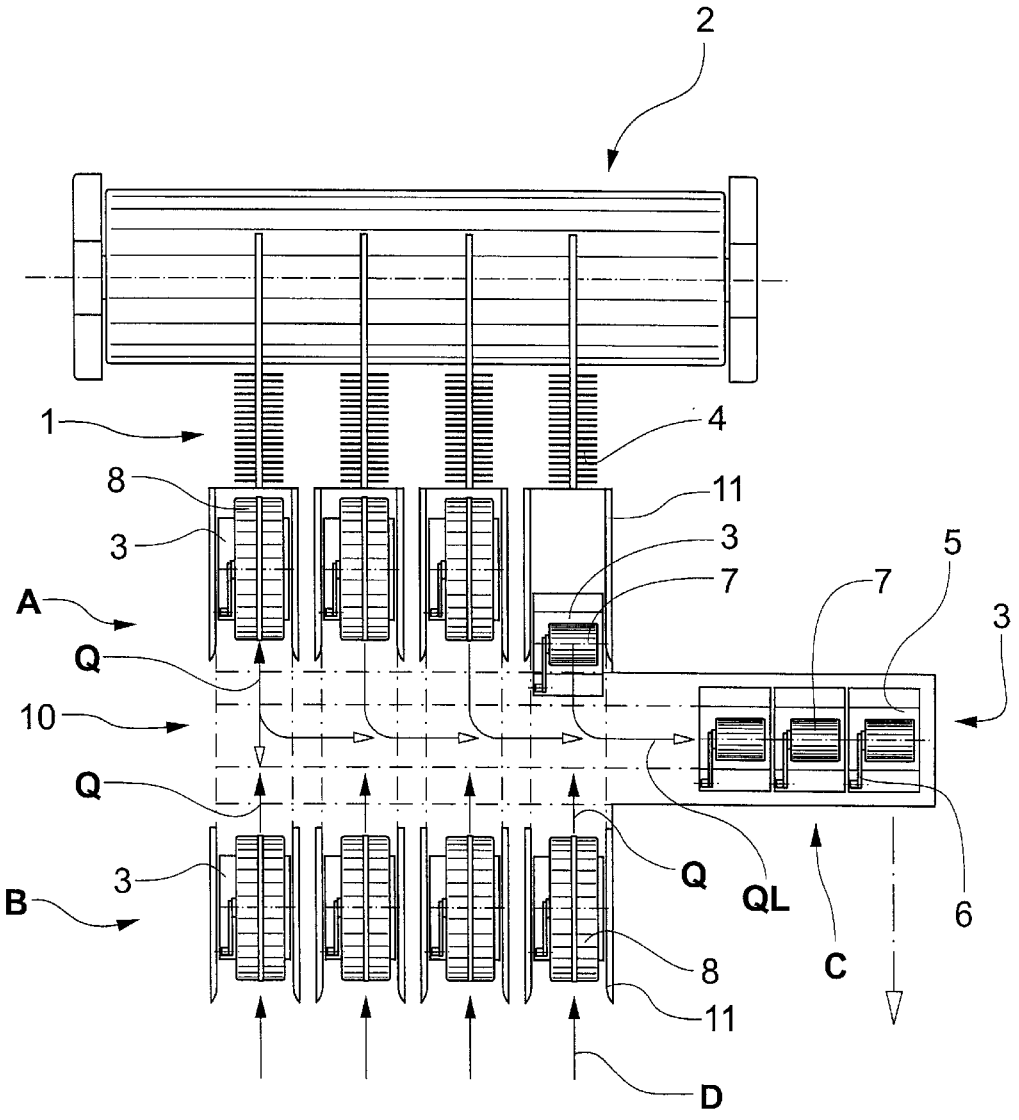
FIGS. 1 and 2 show an installation in accordance with the invention schematically seen from a plan view (FIG. 1) and perspective or three-dimensional view (FIG. 2) and serve for illustrating the method according to the invention.
Figure 2:
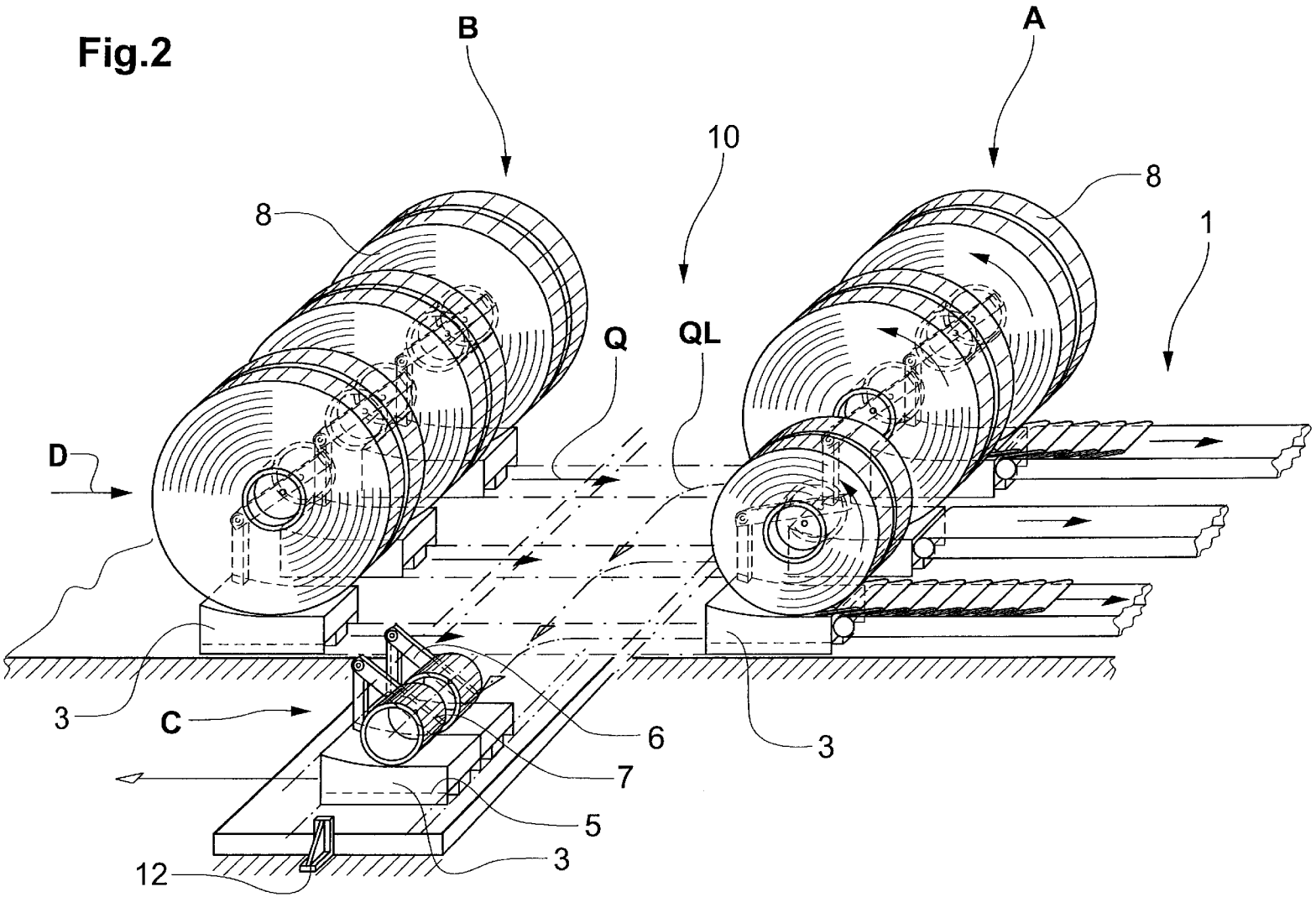

FIGS. 1 and 2 from a plan view (FIG. 1) and in a three-dimensional illustration (FIG. 2), schematically show an installation according to the invention, which installation serves for exchanging roll supports on a plurality of roll processing winding stations 1 (unwinding stations) arranged in a row and essentially in parallel to one another. The winding stations are supply units to a processing system, for example, to a processing drum 2 (collecting drum, collecting-stapling drum, inserting drum, etc.). Between the roll supports 3 coupled to the winding stations and each delivery to the processing drum 2, a buffer store 4 is provided. The capacity of the buffer store is adapted to the processing speed and to the time required for a roll exchange.

The roll supports 3 comprise a carrier 5 designed for being lifted by a carrying fork. On the carrier 5 a roll core 7, which is rotatable around the winding axis, is mounted on a swiveling lever 6.

The roll supports 3 coupled to the winding stations 1 form a first row A of roll supports. They carry rolls 8 with a size getting progressively smaller by unwinding. The roll supports 3 positioned in readiness for the roll exchange form a second row B of roll supports running parallel to the first row A of roll supports and separated from the first row A by the transport alley 10. The roll supports of the second row B are normally loaded with a roll 8. The roll supports 3 removed from the winding stations 1 are positioned at the end of the transport alley 10 in a third row C of roll supports for being transported away. The roll supports of the third row C are normally empty or carry a residual roll.

The transportation steps necessary for a roll support exchange on one of the winding stations are indicated with arrows: Filled-in arrows Q for transverse transport steps, in which roll supports 3 positioned in readiness in the second row B are transported from the second row B into the coupling position (first row A of roll supports) and not filled-in arrows QL for transportation of roll supports from the first row A to the third row C of roll supports comprising a transverse and a longitudinal transportation step.

In FIGS. 1 and 2 the rows of roll supports are arranged in straight lines and parallel to one another. The roll axes are aligned parallel to the rows of roll supports and the roll cores of the roll supports are coaxially arranged in these rows. These however, are not conditions for the method in accordance with the invention. However, it is a condition for the method according to the invention, that the roll supports positioned in readiness in the second row B have the same orientation as the roll supports in the first row A and are each aligned to the one winding station it is to be coupled to.

For positioning the roll supports 3 (arrows D) in readiness in the second row B (not part of the invention) and if so applicable also for positioning roll supports in the coupling position (first row A of roll supports), lateral guides 11 are provided. For positioning the roll supports 3 at the end of the transport alley 10 (third row C of roll supports) for being transported away, a stop 12 is provided, against which the roll supports 3 are pushed.

Figure 3:
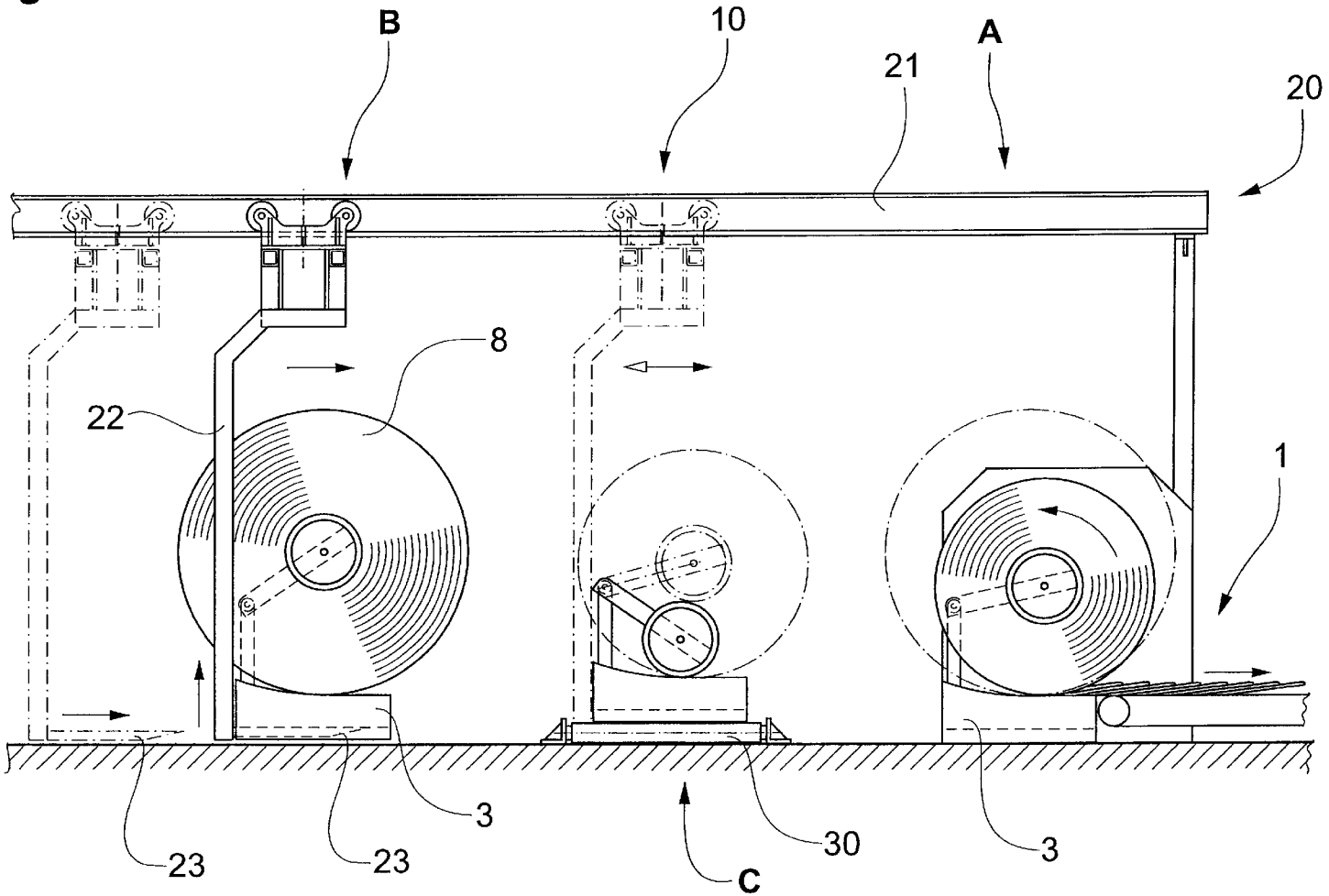
FIGS. 3 and 4 show an exemplary embodiment of the installation in accordance with the invention viewed in elevation parallel to the rows of roll supports (FIG. 3) and transverse to them (FIG. 4)
Figure 4:
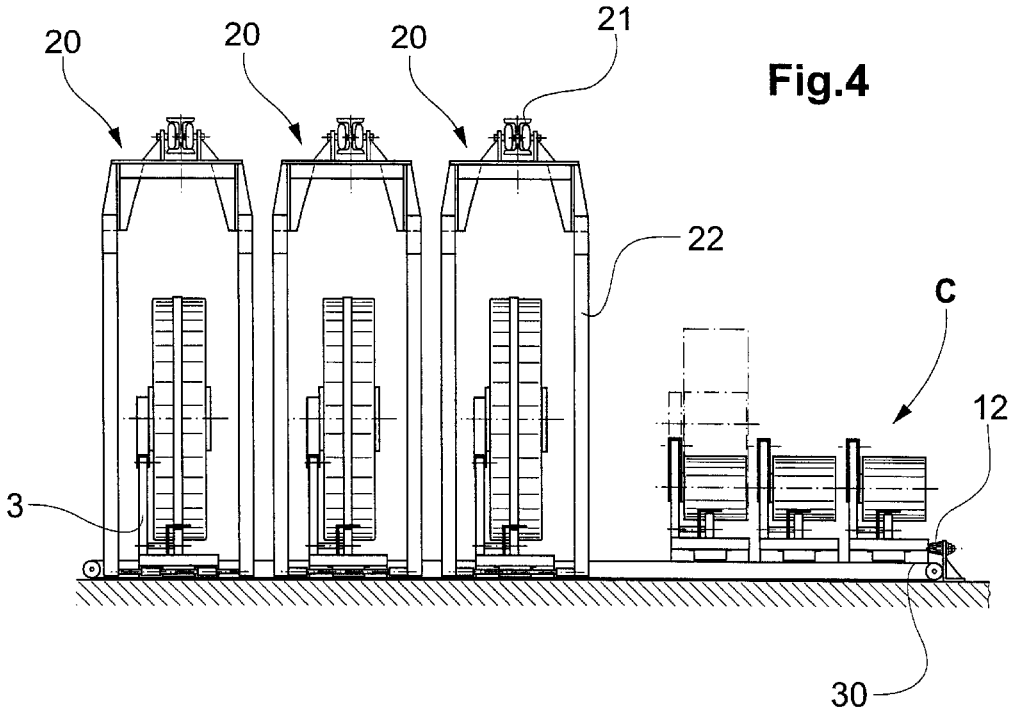

FIGS. 3 and 4 illustrate an exemplary embodiment of the installation in accordance with the invention viewed parallel to the transport alley (FIG. 3) and showing, in particular, the transverse transport means and viewed transverse to the transport alley (FIG. 4) and showing the modularity of the transverse transport means and the longitudinal transport means. The transverse transport means comprises a transverse transport module 20 for every winding station. This module 20 comprises a transverse rail 21 arranged above the transportation level and serving for guiding to and fro a suspended lifting device 22 with an elevatable fork 23. The lifting device 22 is designed and adapted to be moved sideways past loaded roll supports 3 or lifted over these.

For taking hold of a roll support in the second row B of roll supports, the lifting device 22 is positioned beyond this row in a configuration in which it is movable past a ready roll support sideways or over it (indicated with a dot-dash line in FIG. 3) and is brought into a transport configuration. Then the carrying fork 23 runs under the roll support 3 and lifts the roll support into a transport position that is, for example, selected such that the lifting device 22 with the roll support 3 can travel over the longitudinal transport means 30 without any further change of position. In the coupling position (first row A of roll supports) the lifting fork 23 with the roll support 3 to be positioned is lowered and the lifting fork is run The longitudinal transport means 30 as illustrated in FIGS. 3 and 4, is designed as a conveyor belt. It can also be implemented as a conveyor track of driven rollers. If the roller track is arranged to be descending toward the third row C of roll supports, then the force of gravity can be utilized as drive. If the roll supports are equipped with corresponding rollers, then the longitudinal transport means can also be designed as a longitudinal stretch of rail descending toward the third row C of roll supports.

For controlling the installation according to FIGS. 3 and 4, in addition to the means for detecting the necessity of a roll support exchange and for initializing such an exchange, control means for the transverse transport means (running past configuration—transport configuration as well as raised and lowered positions) are necessary as well as control means for controlling the longitudinal transport means such that roll supports transported by it do not interfere with the transverse transportation. For this purpose, for example, a longitudinal conveyor belt is completely stopped to give priority to a transverse transport at any point. A roller track with driven rollers can be locally de-activated. A track, on which roll supports are transported by the force of gravity, can be interrupted by a corresponding local stop.

Figure 5:
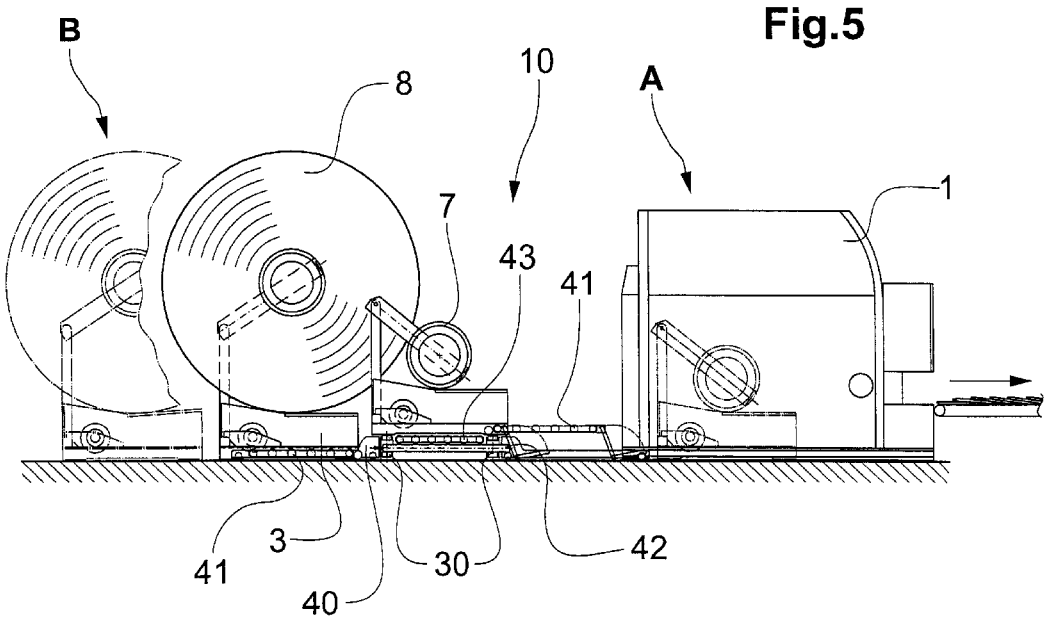
FIGS. 5 and 6 schematically show a further exemplary embodiment of the installation according to the invention in elevation parallel to the rows of roll supports (FIG. 5) and in plan view (FIG. 6)
Figure 6:
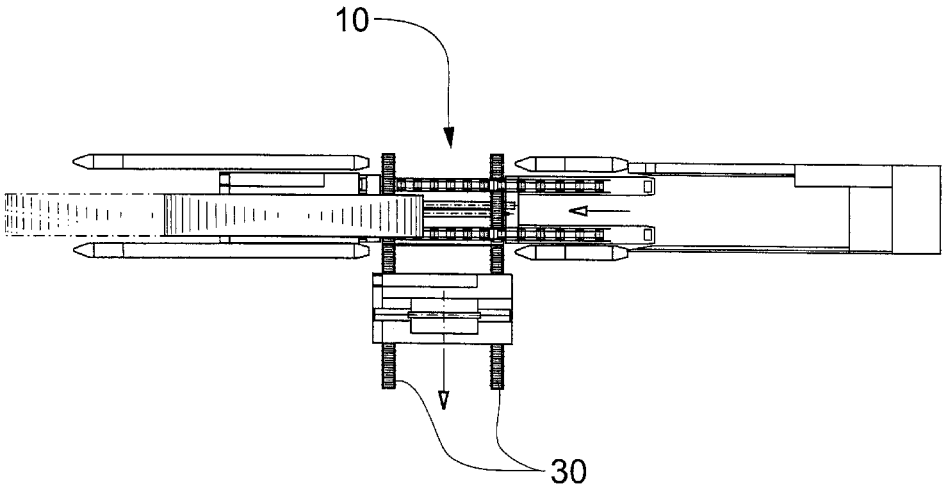

FIGS. 5 and 6 depict a further exemplary embodiment of the installation according to the invention viewed parallel to the transport alley (FIG. 5) and from a plan view (FIG. 6). The longitudinal transport means 30 comprises a pair of rail-like conveyor roller tracks. The transverse transport means once again comprises a number of transverse conveying modules, each of which comprises a traction carriage 40 on the readiness side with an elevatable roller track 41 mounted on it, a traction carriage 42 on the processing side with an elevatable roller track 41 mounted on it and a stationarily arranged, elevatable roller track 43 between the roller tracks of the longitudinal transport means. For being transported up to the longitudinal transport means, roll supports of the first or second row are passed underneath by the corresponding traction carriage, are lifted up (preferably directly to the level of the elevated, stationary roller track 43), are pulled towards the longitudinal transport means, and pushed onto the elevated stationary roller track 43. For being transported away by the longitudinal transport means 30, the roll supports are then lowered. For being positioned in the first or second row, the roll supports are pushed from the elevated stationary roller track 43 onto the elevated roller track 41 of the corresponding traction carriage, transported to the corresponding row and lowered.

FIG. 7 once again illustrates the embodiment of the installation as already depicted in FIGS. 5 and 6, in this case serving for roll support exchange in a roll producing winding station (winding station) producing rolls from a supplied imbricated formation 50 of flat, bendable objects by winding them onto a roll core of a roll support. The operation of the installation in this case is the same as the exchange illustrated by the previous drawing figures except for the roll supports carrying rolls or being empty being inverse. In other words, loaded roll supports 3 carrying a roll 8 are removed from the winding stations and empty roll supports 3 are brought to the winding stations. If the empty roll supports have a smaller dimension transverse to the winding axis (parallel to the transverse transport direction) than loaded roll supports, as is the case for the roll supports illustrated in all figures, then the transport alley 10 has to be wider for the case illustrated in FIG. 7 than for the cases depicted in the other drawing figures.

Figure 7:
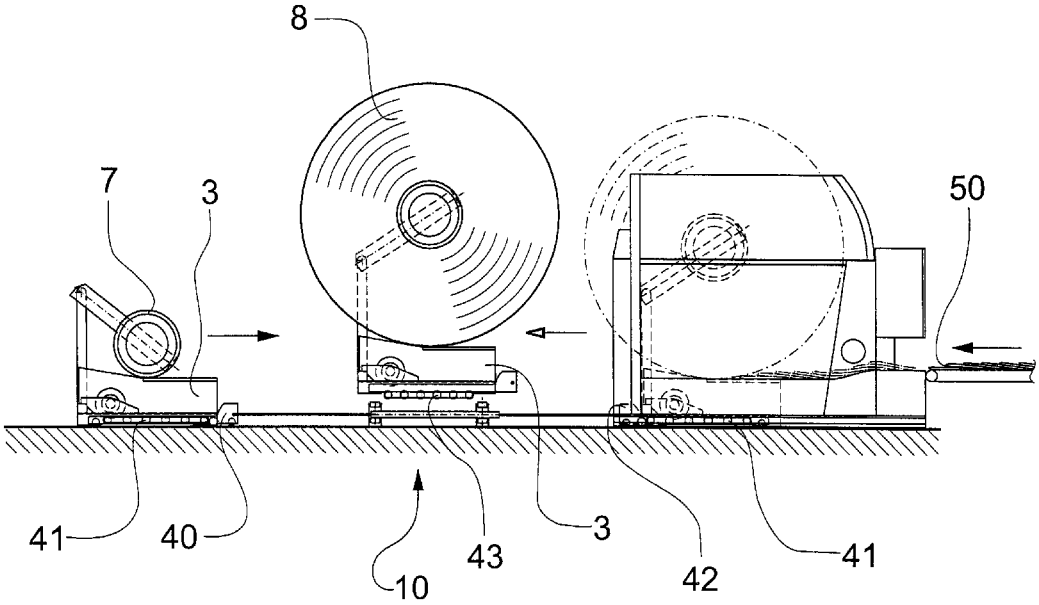
FIG. 7 schematically shows the installation according to FIGS. 5 and 6, serving a roll producing winding station.

As is obvious from a comparison of FIGS. 5 and 7, it is possible without further ado to arrange, in a row of winding stations on which roll supports are exchanged using the method and an installation according to the invention, both roll processing winding stations (unwinding stations) as well as roll producing winding stations (winding stations). In such a case it is not indispensable that all roll supports removed from winding stations are positioned in the third row C for being transported away. Instead of this, selected roll supports can also be removed from a roll-producing winding station by a transverse transport step, be brought to the area of a further winding station in a longitudinal transport step and be positioned in readiness for this winding station in a further transverse transport step. Because the longitudinal transport means advantageously only operates in one direction, this is only applicable for two winding stations, which are correspondingly arranged in the row. For an inverse arrangement of the two winding stations, the removed roll support has to be positioned in the third row C of roll supports and from there has to be transported and positioned in readiness at the corresponding place in the second row B by means of further suitable transport means.

In comparison with known installations, the method and installation according to the invention have the advantage that they are particularly easy to implement, that the further transport means necessary for putting into storage and taking out of storage roll supports are completely independent of the exchange installation, that roll exchanges at different winding stations can be carried out simultaneously or with a time overlap, and that roll exchanges can be carried out very rapidly due to the at least partially possible simultaneity of the roll support removal from the winding station and of the roll support positioning at the winding station.

What is claimed is:

1. A method for exchanging roll supports on a plurality of winding stations (1) arranged in a row such that roll supports (3) coupled to the winding stations form a first row (A) of roll supports on one side of the row of winding stations (1), the roll supports each comprising a roll core (7) mounted rotatable around a winding axis, the method comprising the steps of:

providing in addition to the first row (A) of roll supports a second row (B) of roll supports and a transport alley between the first row (A) and the second row (B), and a third row (C) of roll supports adjoined to one end of the transport alley (10) and aligned in the direction of the transport alley, and a multitude of roll support exchanges each exchange comprising the steps of:

uncoupling a first roll support (3) from the winding station (1) it is coupled to, removing the first roll support from the first row (A) by moving the first roll support transverse to the transport alley (10) and into the transport alley (10), transporting the first roll support along the transport alley (10), and positioning the first roll support in the third row (C) of roll supports, bringing a second roll support (3) being positioned in readiness for an exchange in the second row (B), being aligned to the one winding station (1), for which it is destined, and being oriented in the same manner as the first roll support (3) coupled to said winding station (1), into the first row (A) by moving the second roll support transverse to the transport alley (10) and across the transport alley (10) into the first row (A), and, coupling the second roll support to said winding station (1).

2. The method in accordance with claim 1, wherein the first, second and third row of roll supports (A, B, C) as well as the transport alley (10) run parallel to one another.

3. The method according to claim 1, wherein the roll cores (7) of the roll supports (3) in the rows of roll supports (A, B, C) are aligned coaxially to one another.

4. The method in accordance with claim 1, wherein the transport step, in which a second roll support (3) destined for a specific winding station (1) is transported from the second to the first row, is carried out simultaneously with the transport step, in which a first roll support (3) removed from said specific winding station (1) is transported along the transport alley (10).

5. The method according to claim 1, wherein exchanges on different winding stations (1) are carried out simultaneously or at least with a time overlap.

6. The method in accordance with claim 1, wherein transport steps, in which roll supports (3) are transported from the second row (B) of roll supports to the first row (A) of roll supports including crossing the transport alley (10) are treated with priority over transport steps along the transport alley (10).

7. The method according to claim 1, wherein, in all winding stations (1) rolls are processed, that in the second, row (B) roll supports (3) loaded with rolls are in readiness and that roll supports (3) with empty roll cores (7) are transported along the transport alley (10) and are positioned in the third row (C).

8. An installation for exchanging roll supports on a plurality of winding stations (1) arranged in a row, said installation comprising:

a plurality of roll supports (3), a first group of the roll supports being coupled to the winding stations to form a first row (A) of roll supports on one side of the row of winding stations (1), a second group of the roll supports being spaced from the first group and being disposed in a second row (B) and a third group of the roll supports being disposed in a third row (C), the roll supports each comprising a roll core (7) rotatably mounted around a winding axis, wherein the roll supports positioned in the second row (B) are in readiness for the exchange, a transport alley (10) running between the first and the second rows (A and B) of roll supports, and wherein the third row (C) of roll supports runs in a direction of the transport alley (10) and adjoins an end of the transport alley (10), and a transverse transport means connecting the first and the second row of roll supports for performing transport steps in two directions transverse to the first and second row (A and B) of roll supports and across the transport alley (10), and a longitudinal transport means (30) for performing transport steps along the transport alley (10) in a direction towards the third row (C) of roll supports and for positioning roll supports in the third row (C).

9. The installation in accordance with claim 8, wherein the longitudinal transport means (30) comprises a transportation organ extending over the whole length of the transport alley (10) and over the length of the third row of roll supports (C).

10. The installation according to claim 9, wherein the transportation organ of the longitudinal transport means (30) is a driven conveyor belt, a driven conveyor roller track or a roller track descending towards the third row (C) or a stretch of rail descending towards the third row (C).

11. The installation in accordance with claim 8, wherein the transverse transport means comprises a plurality of transverse conveying modules (20), each of said modules being assigned to one winding station (1) or to a group of adjacent winding stations (1).

12. The installation in accordance with claim 11, wherein every transverse transport module (20) comprises a transverse rail (21) oriented transverse to the transport alley (10) and a lifting device (22) suspended from the rail and movable along the rail.

13. The installation in accordance with claim 11, wherein every transverse conveying module (20) comprises on each side of the longitudinal transport means (30) a traction carriage (40, 42) with an elevatable roller track (41) installed on it and in the area of the longitudinal transport means a stationary, elevatable roller track (43).

14. The installation according to claim 8, wherein one of the transverse transport means and longitudinal transport means (30) is equipped for acting from above and the other one for action from below.

15. The installation in accordance with claim 14, wherein every transverse transport module (20) comprises a transverse rail (21) oriented transverse to the transport alley (10) and a lifting device (22) suspended from the rail and movable along the rail.

16. The installation according to claim 8, wherein the transverse transport means and the longitudinal transport means (30) are equipped for acting from below.

17. The installation in accordance with claim 16, wherein every transverse conveying module (20) comprises on each side of the longitudinal transport means (30) a traction carriage (40, 42) with an elevatable roller track (41) installed on it and in the area of the longitudinal transport means a stationary, elevatable roller track (43).

* * * * *